US007340787B1

(12) United States Patent
Willard et al.

(10) Patent No.: US 7,340,787 B1
(45) Date of Patent: Mar. 11, 2008

(54) PERSONAL BED-ASSISTANCE DEVICE

(76) Inventors: Emmet Elziver Willard, 607 Fairway Forest Dr., Summerville, SC (US) 29485; Jane Leigh Willard, 607 Fairway Forest Dr., Summerville, SC (US) 29485

( * ) Notice: Subject to any disclaimer, the term of this patent is extended or adjusted under 35 U.S.C. 154(b) by 0 days.

(21) Appl. No.: 11/637,903

(22) Filed: Dec. 13, 2006

Related U.S. Application Data

(60) Provisional application No. 60/772,472, filed on Feb. 10, 2006.

(51) Int. Cl.
*A61G 7/10* (2006.01)
*A47G 9/00* (2006.01)

(52) U.S. Cl. ..... 5/662; 5/922; 5/923; 16/444; 16/DIG. 28

(58) Field of Classification Search ..... 5/662, 5/482, 495, 922, 923, 81.1 R; 16/114.1, 16/444, 446, DIG. 28
See application file for complete search history.

(56) References Cited

U.S. PATENT DOCUMENTS

| | | | | |
|---|---|---|---|---|
| 4,536,903 | A | 8/1985 | Parker | |
| 4,611,804 | A * | 9/1986 | Addair | 482/131 |
| 4,696,077 | A * | 9/1987 | Kim | 16/114.1 |
| 4,723,327 | A * | 2/1988 | Smith | 5/89.1 |
| 4,744,115 | A | 5/1988 | Marchione | |
| 4,872,226 | A | 10/1989 | Lonardo | |
| 4,908,889 | A | 3/1990 | Lonardo | |
| 4,944,053 | A | 7/1990 | Smith | |
| 5,005,231 | A | 4/1991 | Lonardo | |
| 5,329,655 | A | 7/1994 | Garner | |
| 5,375,280 | A | 12/1994 | O'Sullivan et al. | |
| 5,530,974 | A | 7/1996 | Rains et al. | |
| 5,608,929 | A | 3/1997 | Crane | |
| 5,787,523 | A | 8/1998 | Lindberg | |
| 6,012,182 | A | 1/2000 | Allen et al. | |
| 6,012,183 | A * | 1/2000 | Brooke et al. | 5/81.1 HS |
| 6,073,279 | A | 6/2000 | Skaler | |
| 6,560,793 | B2 | 5/2003 | Walker | |
| 6,675,418 | B1 | 1/2004 | Armstrong | |
| 2002/0010960 | A1 | 1/2002 | Friedrich | |
| 2005/0217023 | A1 | 10/2005 | Tally | |

FOREIGN PATENT DOCUMENTS

| | | |
|---|---|---|
| CN | 1682625 | 10/2005 |
| SE | 523878 | 5/2004 |

OTHER PUBLICATIONS

ErgoSlide® and Ergo product line at www.ergosafe-products.com.

(Continued)

*Primary Examiner*—Alexander Grosz

(57) ABSTRACT

A personal assistive device that can be installed onto a mattress, preferably a standard hospital bed mattress, to provide handles on the opposing sides of the mattress that may be grasped by a person getting into or out of the bed to ease the transition in or out, or by a person lying in the bed to reposition his or her body while remaining in the bed. The assistive device is a fabric construction that is adapted to be easily and removably installed onto directly over the sheet and other mattress coverings such as a mattress pad on a standard hospital bed mattress.

11 Claims, 2 Drawing Sheets

OTHER PUBLICATIONS

Various mats and sheets for repositioning at www.techforitc.org ("MiniSlide," "MoveMaster," the Phil-E-Slide® "Roller Sheet" amd Sure Hands® "One Way Sheet."

Moveez slider sheet for providing lower friction surface to aid with patient repositioning at http://slidersheets.com.

Bed Rope Ladder and Patient Hand Blocks at www.medesign.co.uk.

* cited by examiner

PERSONAL BED-ASSISTANCE DEVICE

CROSS REFERENCE TO RELATED APPLICATIONS

Applicant claims the priority benefit of U.S. provisional patent application Ser. No. 60/772,472, "PERSONAL BED-ASSISTANCE DEVICE," filed Feb. 10, 2006, incorporated in its entirety herein

BACKGROUND OF THE INVENTION

The inability to reposition oneself in bed is a problem for many people. Often, the problem results from some limitation that a person is experiencing with personal mobility and flexibility in general that is exacerbated by lying prone on a flat surface offering little resistance, such as a mattress. While the soft surface of a mattress is intended to provide a comfortable surface for sleeping, the fact that it sinks into itself when weight is applied to it increases the difficulty some people such as the elderly, surgical patients, stroke survivors, people with hip or back problems, nursing home patients, and people with paralysis often already have with being able to move themselves about. Matters are only made worse by the sheets and bed linens that are fitted onto or tucked tightly around a mattress. Although it is understood that a sheet is needed to protect the mattress and provide a sanitary surface for sleeping on, the sheet also creates a smooth and often slick surface that is difficult for some to push against to move when lying or sitting on the mattress. It is well-known, particularly for mattresses on standard hospital beds which can be raised at one end that patients with limited mobility often gradually slide toward the lower end of the bed.

In addition to providing little resistance and having a smooth surface, mattresses are generally not equipped with anything resembling handles that can be grasped, pushed against or pulled on by a person in the bed to move him or herself around on the mattress. Even if mattresses came with handles, conventional sheets are not designed with openings to accommodate them. While pull bars, rings and other devices providing handles may be available to patients in hospitals and nursing homes, these are large items that must be installed onto the bed frame or brought to the bed each time the patient desire to use them. They are also costly pieces of medical equipment that may not be accessible for many patients or practical for use after the patient leaves the hospital on a patient's own regular bed.

A number of assistive devices for beds and other flat surfaces have been previously developed, such as those disclosed by U.S. Pat. No. 6,675,418 to Armstrong, U.S. Pat. No. 6,560,793 to Walker, U.S. Pat. No. 6,073,279 to Skaler, U.S. Pat. No. 5,787,523 to Lindberg, U.S. Pat. No. 5,608,929 to Crane, U.S. Pat. No. 5,530,974 to Rains, et al., U.S. Pat. No. 5,375,280 to O'Sullivan, et al., U.S. Pat. No. 5,329,655 to Garner, U.S. Pat. No. 5,005,231 to Lonardo, U.S. Pat. No. 4,944,053 to Smith, U.S. Pat. No. 4,908,889 to Lonardo, U.S. Pat. No. 4,872,226 to Lonardo, U.S. Pat. No. 4,744,115 to Marchione, and U.S. Pat. No. 4,536,903 to Parker. Several of these references teach devices that may be used by others to reposition or transport a person within or from a bed. While some of the references teach fabric devices having handles, none of the references teach a device having handles comprised of fabric-encased ropes.

The present invention provides a way to put handles on a mattress, and preferably on a standard hospital bed-sized mattress that can be used not only by a person in the bed to assist with repositioning or but also to ease the transition into or out of the bed.

Furthermore, novelty moisture detectors are also well known. These include detectors with bodies in the form of frogs or other creatures.

Batteries or solar cells connected to rechargeable batteries may be used to power these detectors. It is important to know when the batteries are no longer delivering sufficient voltage to operate the detector. A detector with a dead battery gives the same signal as one indicating sufficient moisture, even when the soil is dry.

Thus, there remains a need for improvements in moisture detectors, regardless of type, that inform the user that the battery power is low.

SUMMARY OF THE INVENTION

According to a first embodiment and briefly recited, the present invention relates to an assistive device that can be positioned on a mattress, preferably a standard hospital bed-sized mattress that is eighty inches (80") long, thirty-six inches (36") wide and six inches (6") thick, to provide handles on the opposing sides of the mattress. The handles may be grasped by a person getting into or out of the bed to ease the transition in or out, or by a person lying in the bed to reposition his or her body while remaining in the bed.

The assistive device is a fabric panel that is adapted to be easily and removably installed onto a mattress directly over the sheet and other mattress coverings such as a mattress pad that are commonly put on a mattress for use. The assistive device is constructed from a single rectangular shaped-panel of durable and machine-washable fabric. The device has two pockets carried on the topside surface of the fabric panel, i.e., the surface of the device that the person will lie directly upon when the device is installed on a mattress. Each pocket encases a length of rope. The pockets are constructed to hang from the topside surface of the assistive device and are located on the assistive device to become positioned on the opposing sides of the mattress after installation of the device onto a mattress. The ropes encased in the pockets serve as handles that may be grasped and held onto by the person in the bed.

The assistive device is installed onto the mattress by wrapping it around the middle third of a mattress, in the area where a person's hips would be positioned when lying in the bed. It is held in place on the mattress by securing means carried on the shorter sides of the device that are brought together when the device is wrapped around the mattress.

An important feature of the present invention is that it can be used by a person in the bed to reposition him or herself up or down in the bed or to roll from side to side, or to ease the transition to or from the bed. The device augments a person's ability to independently care for him or herself, provides a measure of physical activity to a person who might otherwise be bed-bound, reduces the person's risk for developing pressure sores and, for some people, eliminates the need to call for assistance simply to change position in bed.

Another important feature of the present invention is that it can be easily installed onto a mattress directly over a sheet and other mattress covering that may already have been put on the mattress.

Still another feature of the present invention is that it is preferably constructed from any durable, machine-washable fabric that may be readily available. As with installation, the assistive device may easily be removed from the mattress either by itself or along with the sheet and washed in the same manner as other bed linens are washed.

These and other features and their advantages will be apparent to those skilled in the art of personal assistive devices from a careful reading of the Detailed Description of Preferred Embodiments accompanied by the following drawings.

DETAILED DESCRIPTION OF PREFERRED EMBODIMENTS

The present invention is a personal assistive device that can be easily and removably installed onto a mattress, preferably a standard hospital bed mattress, to provide handles on opposing sides of the mattress that may be used to assist a person in changing positions in the bed and to get into and out of the bed. The assistive device is a rectangular shaped fabric panel carrying two handles created from the fabric comprising the assistive device on the topside surface of the device, and a pair of securing means positioned along the edges of the shorter sides of the fabric panel that may be joined to secure the assistive device to the mattress. The assistive device is referred to as "personal" because it can be used by the patient to change his or her own position within the bed or to assist him or herself in getting into or getting out of the bed.

Figure 1:
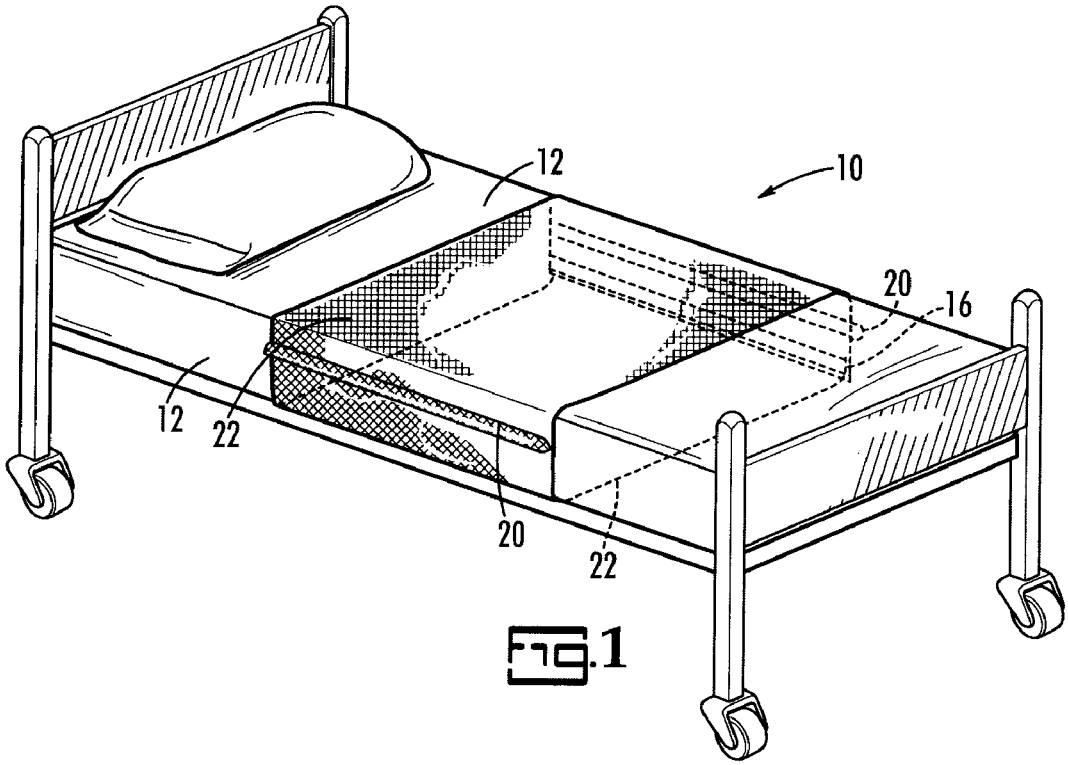
FIG. 1 shows a side view of the assistive device and illustrates placement of the assistive device onto a standard hospital bed mattress.

Referring now to the drawings, FIG. 1 illustrates a side view of a preferred embodiment of the inventive assistive device (10) installed on a standard hospital bed mattress (12). Also shown in the illustration are the two handles (20) that become positioned on the opposite sides of the mattress to be within reach of a person using the bed after installation. The handle on the side of the mattress visible to the viewer is illustrated in solid lines (20). Dashed lines are used to illustrate where a second handle (20) would be positioned on the opposite side of the mattress that would be hidden from view. Dashed lines are also used to show the position of the assistive device (10) under the mattress (22) and a preferred method for securing the assistive device to the mattress (16).

As further illustrated by FIG. 1, the inventive assistive device comprises a single panel of fabric cut in a rectangular shape having a topside surface (22) and an underside surface. The topside surface (22) of the assistive device is the side that a person lies upon in the bed when the assistive device is installed onto a mattress as illustrated. The assistive device is installed onto a mattress by wrapping the device around the mattress and using securing means (16) to hold the device in position. The device is preferably used on a standard hospital bed-sized mattress (14) having a thirty-six inch (36") width and six inch (6") depth. However, it is contemplated that the assistive device could be adapted for use on smaller mattresses, such as those used on child or toddler beds, or larger mattresses.

Figure 3:
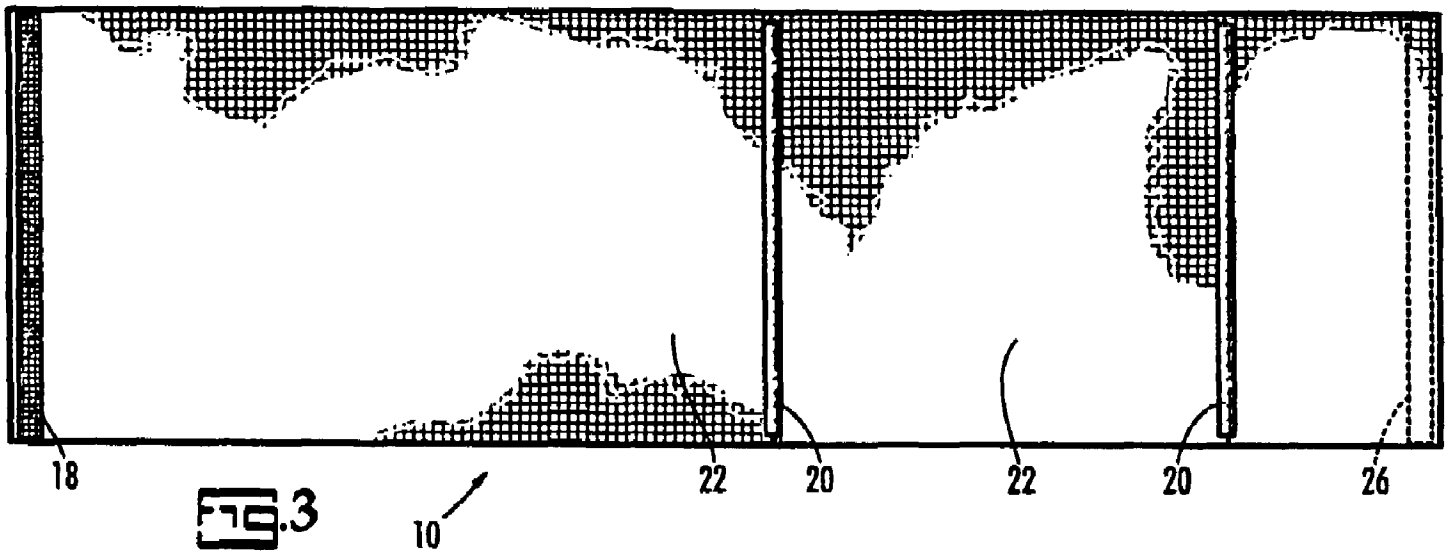
FIG. 3 is a top view the preferred embodiment of the present invention and illustrates the position of the two pockets created in the topside surface of the fabric which serve as the handles after installation of the assistive device on a mattress, and the location of the securing means, preferably Velcro adhesive strips, on the shorter sides of rectangle of fabric comprising the device, one strip being placed on the topside surface of the fabric and the second strip being placed on the bottom side.

When completely unfolded as shown in FIG. 3 and as will be described in detail below, the fabric comprising the finished assistive device should be reasonably sized to wrap around the central third of the chosen mattress. The assistive device is preferably constructed from any durable, pre-shrunken, machine-washable fabric composed of natural or synthetic fibers, or blends thereof that would be comfortable in contact with a person's skin. Use of this type of fabric enables installation of the assistive device onto a mattress directly over the customary bed linens, including the mattress pad and sheet, since the device can be removed and washed along with the other bed linens when necessary. In the alternative, the device may be constructed from a disposable fabric for "one-time" use.

The assistive device is installed by inserting one of the ends of the device under the mattress. The device is installed so that the topside surface (22) of the assistive device faces away from the mattress and the handles (20) will become positioned on either side of the mattress (12) once the device is wrapped around the mattress and secured as shown in FIG. 1. The portion of the assistive device not placed under the mattress is then folded over the top of the mattress to wrap around the entire mattress. The shorter sides, or opposing ends, of the device are brought together and secured to each other using the securing means (16) carried on the device. While the preferred embodiment is secured to the mattress by securing means carried on the ends of the device that overlap after installation, alternate designs are contemplated which may use other securing means, such as zippers or hooks, that would not require overlapping of the ends of the device. Once secured, the device may be pulled around the mattress to position the handles (20) on the opposing sides of the mattress so that the person who uses the device in the bed can comfortably grasp the handles.

The assistive device is installed onto the area of the mattress approximately where a person's hips and midsection would be positioned when lying or sitting in the bed. In this position, the person in the bed should be able to reach down on either side of the mattress and grasp onto the ropes carried in the pockets created in the assistive device that become located on the opposing sides of the mattress after installation to use the pockets as handles. The person may push down and against these handles with both hands to move his or her body up on the mattress. Or, the person may reach over to one of the handles and use it to pull on with one or both hands to roll from side to side in the bed.

Figure 2:
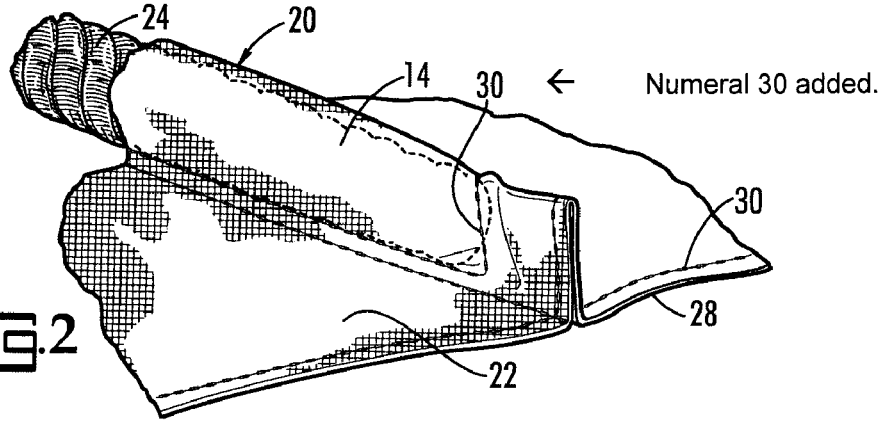
FIG. 2 is a cutaway detailed view of the end of one of the handles, showing the construction of the pocket formed in the device and encasement of the rope to create the handles.

FIG. 2 illustrates a detailed view of one end of one of two handles (20) created from the fabric comprising a preferred embodiment of the device. Also shown by cutaway and dashed lines is the position (14) of a length of rope (24) encased by a pocket created in the topside surface of the fabric (22) comprising the device and which serves as one of the handles previously shown in FIG. 1. The ropes (24) are preferably comprised of nylon or another material capable of withstanding machine washing. Ropes of any reasonable size for serving as handles depending upon the hand size of the person who will use the device may be used. As shown in the illustration, in this embodiment the fabric is folded around a single length of rope (24) that is positioned on the underside of the fabric panel. Stitching means (30) are then used to encase the rope within the fabric pocket and to reinforce the pocket at both ends of the encased length of rope (24), one end being illustrated in FIG. 2. The detailed view also illustrates how the edges (28) of the assistive device are finished by turning the fabric under and hemming it with stitching means (30).

FIG. 3 is a view of the topside surface (22) of a preferred embodiment of the inventive assistive device. Diagonally hatched lines are used to show a preferred location, shape and size of the pockets (20) that are created in the topside surface (22) of the device to encase the lengths of rope and serve as the handles (20) in the finished assistive device. Also shown by a darker and irregularly hatched area (18) and dashed lines (26) are preferred securing means comprising a pair of Velcro or comparable adhesive strips. In the illustrated embodiment, one of the adhesive strips is attached near to the end of one of the shorter side of the device on the topside surface (22) of the fabric. The second strip of adhesive attached to the opposing shorter side of the device is carried on the underside of the fabric (26). This allows the assistive device to be secured to the mattress by overlapping the opposing ends of the rectangular fabric panel to bind the adhesive strips.

Figure 4:
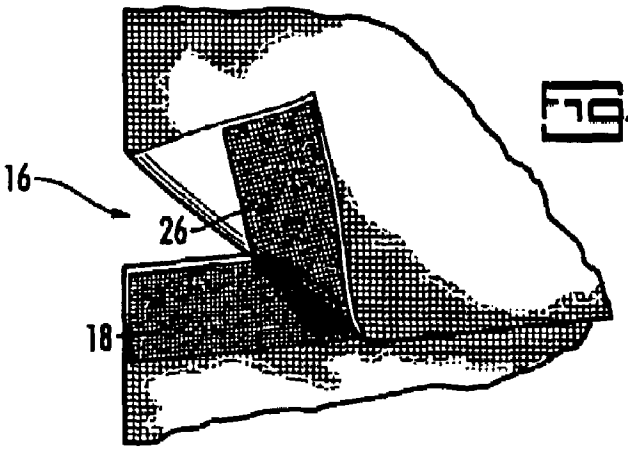
FIG. 4 is a detailed view of the ends of the assistive device which overlap when the device is installed on the bed, and illustrates operation of the securing means, preferably a pair of Velcro adhesive strips locatable at the opposing ends of the device.

FIG. 4 is a detailed view of a method for securing (16) a preferred embodiment of the assistive device using Velcro or comparable adhesive strips. The adhesive strips are carried on the topside surface (18) and underside surface (26) near the edges of the opposing shorter sides of the assistive device. While not illustrated, the strips are attached to the fabric panel with stitching means.

Although not illustrated, it is contemplated that the assistive device may be adapted for use on mattresses of various sizes, such as those used on toddler beds and other beds that may be used by children. It is also contemplated that the assistive device may be adapted for use on larger mattresses, even though a person would not be able to simultaneously reach the handles on both sides of the mattress, as the handles would still be useful to assist with transitioning into and out of the bed and rolling from side to side within in the bed.

It is intended that the scope of the present invention include all modifications that incorporate its principal design features, and that the scope and limitation of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art of personal assistive devices from the foregoing description of the preferred embodiments without departing from the spirit or scope of the present invention.

EXAMPLE

An example of the preferred embodiment of the present invention for use on a standard hospital bed mattress, and as illustrated in the drawings, is described below. As described, the embodiment of the assistive device comprises a rectangular shaped fabric panel carrying two handles created in the fabric on the topside surface of the assistive device, and a pair of adhesive strips positioned along the edges of the shorter sides of the fabric panel that are used to secure the assistive device to the mattress.

When completely unfolded as shown in FIG. 3, the fabric comprising the finished example assistive device measures ninety-two inches (92") long by thirty inches (30") wide. The example assistive device is therefore constructed from a slightly larger fabric panel so that the edges may be turned and finished with stitching means as shown in FIG. 2, and the two pockets may be created from the same fabric for encasing two length of rope to serve as the handles of the device (20) as shown in FIG. 1 and FIG. 3. The example assistive device is constructed from ten (10) ounce, pre-shrunken cotton denim, which is durable and machine-washable.

The assistive device is installed onto the area of the mattress where a person's, or hospital patient's, hips and midsection would be positioned when lying or sitting in the bed as shown in FIG. 1.

Two handles are created on the topside surface of the example assistive device by folding the fabric comprising the device around two lengths of nylon marine rope having a three-quarter inch (¾") diameter as shown in FIG. 2. In this embodiment, two twenty-nine inch (29") lengths of rope (24) are used. The handles are created by first placing one of the lengths of rope across the width of the assistive device. The fabric is then folded immediately around the rope to encase the rope in a small pocket as shown in FIG. 2. Also shown in FIG. 2 are stitching means (30) that are used to close the pocket around the length of the rope (24) and to close and reinforce the fabric at the ends of the pocket.

A second handle is then created by repeating the entire process using the second length of rope. The example assistive device carries one pocket approximately six inches (6") from one of the shorter sides of the rectangular fabric panel and a second pocket approximately forty-two inches (42") from, and parallel to, the first as shown in FIG. 3. These measurements produce an assistive device having handles that become positioned on the sides of the mattress approximately two inches (2") from the top edges of the mattress as shown in FIG. 1. In this position, an adult should be able to push down and against these handles with both hands to move his or her body up on the mattress. Or, the person may reach over to one of the handles and use it to pull on with one or both hands to roll from side to side in the bed. The measurements may be adjusted to create handles in any position that may be comfortably used by the person in the bed, depending upon the size of the person and the mattress.

In the example assistive device now described, the shorter sides of the fabric panel comprising the device overlap on one side of the mattress to secure the device to the mattress (16) as shown in FIG. 1. As illustrated in FIG. 4, a pair of Velcro or comparable adhesive strips (16) measuring two inches (2") wide and thirty inches (30") long is attached to the shorter sides of the example assistive device with stitching means (30) to serve as securing means for the device. The strips are attached to the panel so that the strips will bind together when the device is wrapped around the mattress for installation as shown in FIG. 1. As illustrated in FIG. 3, one strip is applied to the topside surface of one of the shorter sides of the fabric panel (18) and the second strip is applied to the underside surface of the opposing shorter side (26).

The example assistive device is installed by inserting the portion of the device that does not carry the handles under the mattress with the topside surface of the assistive device facing away from the mattress. The assistive device is positioned under the mattress so that the adhesive strip carried on the inserted side is exposed and can be folded up onto the thickness of the mattress. The portion of the assistive device not under the mattress is then folded over the top of the mattress to wrap around the entire mattress as shown in FIG. 1. The adhesive strip on the end of the assistive device that is folded over the mattress is then placed onto the end that is folded up from the portion of the device that is under the mattress. Once secured, the device is pulled around the mattress to place the handles in the best possible position for the person in the bed.

What is claimed is:

1. A personal assistive device dimensioned to be removably installed onto a mattress to enable a person to reposition themselves up or down on the mattress when lying on said mattress in bed or to roll from side to side and for transitioning into or out of the bed, comprising:

a rectangular shaped fabric panel having a first end and a second opposing end comprised of two shorter sides of said fabric panel, said ends being separated by two longer sides of equal length;

a pair of handles formed into the topside surface of said fabric panel, each of said handles comprising a pocket encasing a length of rope; and securing means carried on the edges of the shorter sides of the fabric panel for securing said assistive device onto said mattress for use.

2. The personal assistive device of claim 1, wherein said mattress comprises a standard hospital bed mattress having a thirty-six inch (36") width and six inch (6") depth.

3. The personal assistive device of claim 1, wherein said fabric panel measures ninety-two inches (92") long by thirty inches (30") wide.

4. The personal assistive device of claim 1, wherein said fabric panel is comprised of a durable, pre-shrunken, machine-washable fabric composed of natural or synthetic fibers, or blends thereof that would be comfortable in contact with a person's skin.

5. The personal assistive device of claim 1, wherein said handles are created by encasing two lengths of nylon marine rope in a pocket formed in the topside surface of said fabric panel from the fabric comprising said fabric panel.

6. The personal assistive device of claim 5, wherein said lengths of rope are twenty-nine inches (29") long and three-quarter inch (¾") in diameter.

7. The personal assistive device of claim 1, wherein said handles are created by placing said lengths of rope across the width of said fabric panel on the underside of said fabric panel and folding said fabric around said lengths of rope to create pockets encasing said lengths of ropes.

8. The personal assistive device of claim 1, wherein stitching means are used to close said pockets around said lengths of said nylon rope and to close and reinforce the fabric at both ends of said lengths of nylon rope.

9. The personal assistive device of claim 1, wherein a first handle is created six inches (6") from one of the shorter sides of said rectangular fabric panel and a second handle is created forty-two inches (42") from and parallel to said first handle.

10. The personal assistive device of claim 1, wherein said securing means is a pair of two inch (2") wide separable hook and loop type fasteners that are thirty inches (30") long.

11. The personal assistive device of claim 1, wherein said fabric panel is comprised of a disposable fabric.

* * * * *